United States Patent [19]

Lamore

[11] Patent Number: 4,760,620

[45] Date of Patent: Aug. 2, 1988

[54] FEATHER BRUSH AND METHOD FOR THE FABRICATION THEREOF

[76] Inventor: Patrick H. Lamore, 2577 Belle View Dr., Rochester, Mich. 48064

[21] Appl. No.: 50,558

[22] Filed: May 18, 1987

[51] Int. Cl.[4] ..... A46B 3/02; B60S 3/06

[52] U.S. Cl. ..... 15/181; 15/DIG. 2; 15/53 A; 15/230.12; 15/230.14; 15/234; 300/21

[58] Field of Search ..... 15/1, 3, 53 A, 53 AB, 15/DIG. 2, 179, 181, 186, 192, 230, 230.12, 234; 223/47; 300/21

[56] References Cited

U.S. PATENT DOCUMENTS 2,679,711 6/1954 Learnard ..... 428/6
3,539,432 11/1970 Chee ..... 161/15
4,217,383 8/1980 Patterson ..... 438/95
4,227,278 10/1980 Raskin ..... 15/234
4,689,749 8/1987 Glogowski ..... 15/53 AB X

*Primary Examiner*—Edward L. Roberts
*Attorney, Agent, or Firm*—Krass & Young

[57] ABSTRACT

A feather brush comprises a resilient member having a plurality of feathers inserted thereinto so that their shafts penetrate through to a second side thereof where they are embedded in a body of solid adhesive material so that they cannot be removed therefrom. The brushes are particularly well adapted for use as large area tack brushes employed in the preparation of articles for painting or coating. Also disclosed herein is a method for the manufacture of such brushes.

13 Claims, 2 Drawing Sheets

FIG. 3
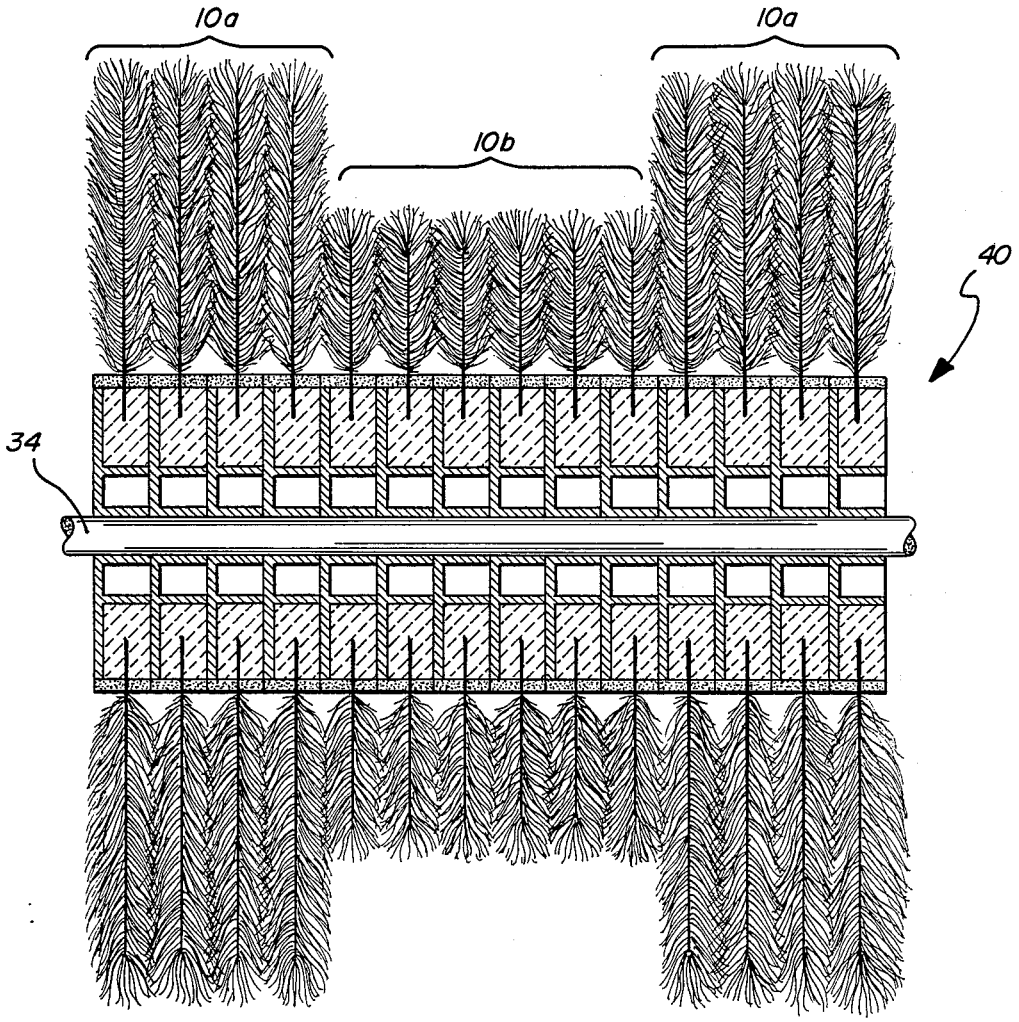
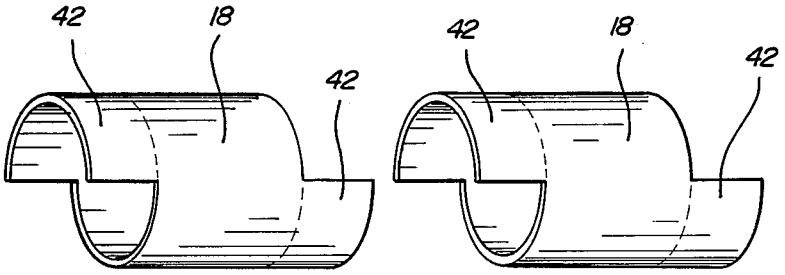
FIG. 4

FEATHER BRUSH AND METHOD FOR THE FABRICATION THEREOF

FIELD OF THE INVENTION

This invention relates generally to brushes and in particular to brushes fabricated from feathers. The instant invention is particularly well suited for fabrication of tack brushes utilized for removing dust from surfaces prior to the application of paint or other such coating thereto.

BACKGROUND OF THE INVENTION

Removal of dust is very important in processes for painting or otherwise coating articles insofar as such dust particles will form blemishes in the finish of the article. Dust removal by wiping is frequently counterproductive because such contact can introduce further contamination in the form of lint or other extraneous matter. It has been found in many instances that brushes may be employed to remove fine particles from a surface prior to coating and such brushes are called tack brushes.

Feather brushes have been found particularly well suited for use as tack brushes because the feathers are soft and therefore not prone to mar delicately finished surfaces and furthermore, the feathers do not have a tendency to shed contamininating particles. The feathers of ratites, such as ostriches and emus, are presently favored for the fabrication of such brushes. Ratite feathers have been found to develop and hold a static electrical charge causing them to attract and retain dust particles from a surface. Furthermore, ratite feathers can be made to rapidly give up their static charge and deposit particles of dust attached thereto by subjecting the charged feathers to an ionizing source. Other feathers, including synthetic substitutes may be employed likewise in the fabrication of useful brushes and accordingly, the term "feathers" as utilized herein is meant to apply to all such natural and synthetic materials.

In a typical coating operation, relatively large area tack brushes are utilized. Heretofore, such brushes have been fabricated by rather cumbersome techniques. For example, the shafts of feathers were affixed to an arbor or similar base by winding wire thereabout. In other instances, a plurality of holes were drilled into a base and the shafts of feathers were set into those holes and affixed with adhesive material. In yet other processes, the shafts of the feathers are adhesively affixed to a first supporting member, and a second member is laminated over the shafts. Such previously employed techniques are relatively lengthy to implement, do not allow for precise positioning of the feathers during brush fabrication, and produce an article having low durability.

The present invention provides a rapid, easy to implement process for the production of feather brushes. As will be described in greater detail hereinbelow, the present invention allows for ready and adjustable positioning of feathers during the fabrication of brushes. Furthermore, the brushes produced thereby can be formed as disks, and a plurality of such disks may be stacked upon a common arbor so as to provide a generally elongated tack brush adapted to clean large areas. The fact that a large tack brush can be assembled from a plurality of disks confers additional advantage insofar as the resultant contour of the large area tack brush may be controlled to a predetermined profile by selecting disks of varying diameters, thereby allowing the tack brush to accommodate irregularly shaped objects. Furthermore, the use of a plurality of disk-shaped brushes of the present invention permits replacement of worn sections of a large area tack brush without the necessity for replacement of the entire brush. In other instances, the brushes may be manufactured to still different configurations.

As will be described in greater detail hereinbelow, the present invention encompasses the use of a resilient body of material such as a foamed polymer to support the shafts of feathers in a predetermined and readjustable relationship upon a support member. Once the proper alignment of feathers is obtained, an adhesive potting compound is utilized to form a solid base binding the feathers in the predetermined and adjusted relationship.

As previously mentioned, the prior art methods involved drilling holes in a base and inserting feathers thereinto, on laminating feather shafts into a base. Techniques of this type do not allow for repositioning of the feathers once they are affixed and accordingly, precisely contoured and dimensioned feather brushes cannot be fabricated by such techniques. U.S. Pat. No. 4,227,278 discloses the fabrication of a feather duster by such techniques.

There is disclosed in U.S. Pat. No. 3,539,432 a method for the fabrication of a decorative feather necklace or lei by insertion of relatively small feathers into a foam base. The method disclosed therein is not capable of being adapted to produce a strong article suitable for use as a tack brush because the feathers are not subsequently embedded in a potting material so as to form a rigid base.

U.S. Pat. No. 4,217,383 discloses the fabrication of a pile carpet by a technique which includes pulling loops of yarn through a foam base and subsequently gluing the backs of those loops to the base. The object in the '383 patent is to fabricate a relatively flexible carpet while preventing unravelling of the pile loops. Accordingly, the disclosure teaches the fabrication of a flexible bound aggregate of loops and does not teach the formation of a relatively rigid base suitabie for use as the backing member of a brush. Therefore, the U.S. Pat. No. 4,217,383 patent provides no teaching useful in the manufacture of feather brushes.

It will then be appreciated that the present invention provides for improved, durable feather brushes and methods for their manufacture by a technique which is novel, easy to implement and capable of providing precisely configured brushes readily adapted to be utilized as tack brushes for contoured surfaces.

BRIEF DESCRIPTION OF THE INVENTION

There is disclosed herein a feather brush having a resilient member adapted to be penetrated by the shaft of a feather. The brush further includes a plurality of feathers, the shafts of which are inserted into the resilient member in a predetermined pattern so that a portion of each of the shafts penetrates the resilient member and projects from a second side thereof, as well as a body of adhesive material disposed on the second side of the resilient member affixing the shafts so that they cannot be removed therefrom.

In one particular embodiment, the brush further includes a disk-shaped hub having the resilient member affixed to the perimeter thereof with the feathers inserted into the resilient manner in a pattern corresponding to the radius of the hub so as to provide a disk-shaped brush. The disk-shaped brush may include a central opening thereby adapting it for mounting on an arbor. The disk-shaped brush may further include a projecting member associated with the hub proximate the central opening and adapted to engage a proximately disposed disk-shaped brush so that the brushes may rotatingly engage one another upon the arbor.

The resilient member may be a foamed polymeric material and the feathers may be natural feathers, such as ratite feathers or the feathers of other fowl, or they may be synthetic feathers.

In accord with the principles of the present invention, a feather brush may be fabricated comprising a plurality of disk-shaped brushes mounted in side-by-side relationship upon an arbor. In some instances, the feathers of adjacent disk-shaped brushes may all be of the same length so that the brush produced thereby is of substantial uniform diameter. In other instances, the feathers of a first disk and those of a second disk may be of different lengths so that the brush has a diameter which varies along the length thereof.

In accord with the disclosure herein, a brush may be fabricated by providing a generally disk shaped hub, providing a strip of resilient material capable of being penetrated by the shaft of a feather. Substantially encircling the hub with the strip of resilient material so as to define a cylindrical cavity, the height of the cavity corresponding to the width of the strip and the diameter of the cavity corresponding to the diameter of the disk. In accord with the method, a plurality of feathers are inserted into the resilient member in a predetermined pattern so that the shafts thereof project into the cylindrical cavity and the resilient member retains the feathers in the predetermined pattern. The shafts of the feathers are adhesively affixed within the cavity so as to provide a disk shaped feather brush.

BRIEF DESCRIPTION OF THE DRAWINGS

FIG. 3 is a tack brush structured in accord with the principles of the instant invention as fabricated by assembly of a plurality of disk shaped brushes upon a common arbor;

FIG. 4 is a detail of a portion of the hubs employed in one embodiment of the present invention as adapted to engage one another for rotation.

DETAILED DESCRIPTION OF THE INVENTION

Figure 1:
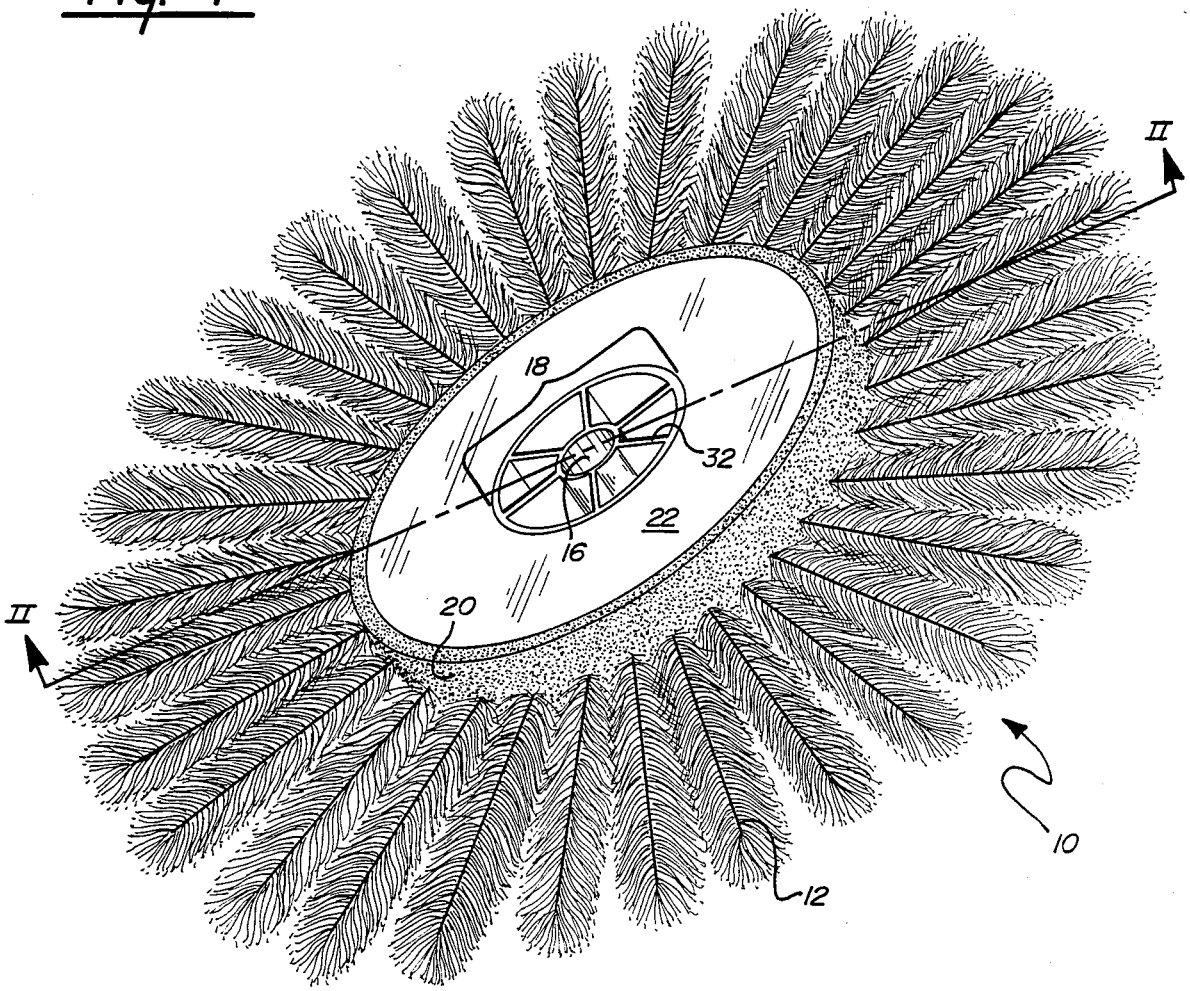
FIG. 1 is a perspective view of a disk shaped feather brush structured in accord with the principles of the instant invention.

Referring now to FIG. 1, there is shown a feather brush 10 structured in accord with the principles disclosed herein. The brush 10 is a disk-shaped brush having a plurality of radially arrayed feathers 12. The brush 10 includes a hub having a central opening 16 therein defined by a central sleeve 18.

The brush further includes a resilient strip 20 disposed about the perimeter of the hub 14. The space between the central sleeve 18 and the resilient member 20 is filled with an adhesive potting compound 22 which affixes the feathers 12 therein.

Figure 2:
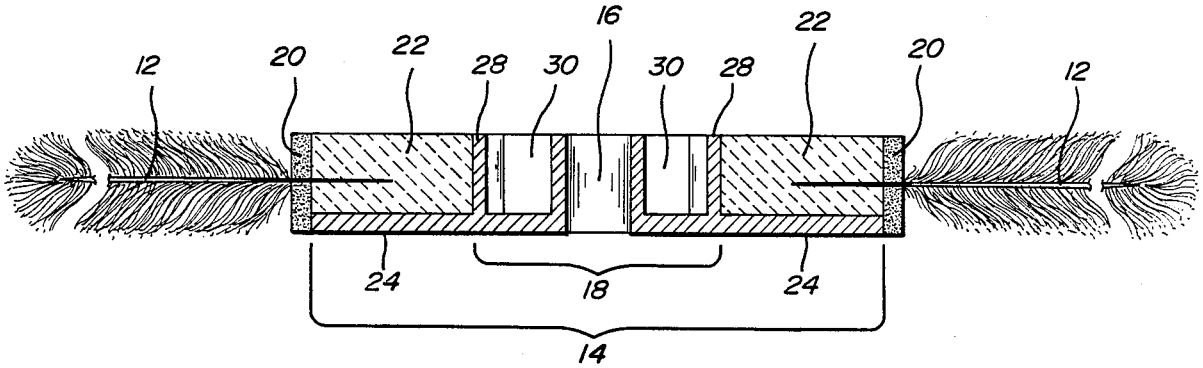
FIG. 2 is a cross sectional view of the brush of FIG. 1 taken along line II—II depicting the construction thereof.

Referring now to FIG. 2 there is shown in greater detail the construction of the feather brush 10 of FIG. 1. FIG. 2 is a cross sectional view of the brush taken along lines II—II. The brush is comprised of a generally disk-shaped hub 14 having a central opening 16 therein defined by a central sleeve 18.

The hub 14 includes a flange 24 projecting radially from the central sleeve 18 and defining the outer perimeter of the hub 14. Affixed to the outer perimeter is a resilient strip of material 20. This strip may be affixed by adhesive or by mechanical means such as nails or clips and may be fabricated from a wide variety of materials. The resilient strip 20 need not be of high durability but must be capable of being penetrated by the shaft of a feather 12 passed therethrough.

It is the function of the resilient strip 20 to hold the feather 12 in place during fabrication of the brush so as to allow repositioning thereof; and accordingly, a wide variety of materials may be so employed. Among some of the materials are rubber, polymers, cardboard and the like. Particularly preferred are foamed materials such as foam rubber or foamed polymer because such materials are readily penetrated by feather shaft but yet are capable of securely holding the feathers. One preferred material is a foamed polyurethane sold under the trade name of "Ethafoam", by the Dow Chemical Company.

It will be noted that the resilient member 20, the flange 24 and the central sleeve 18 of the hub 14 cooperate to define a generally tororidal cavity therebetween, into which the shaft of the feather 12 projects. This cavity is filled with a solid, adhesive potting material so as to provide a solid base affixing the feather shaft therein. This body of potting material 22 is preferably cast into the tororidal cavity in a liquid form after the feathers have been properly positioned in the resilient member.

There are a wide variety of materials which may be employed as the potting compound. Included are various adhesives such as epoxy or silicone, which compounds are initially in a liquid state and subsequently undergo chemical reaction to harden. In other instances, potting may be simply accomplished by pouring a molten compound such as a molten polymer into the cavity and allowing it to cool and subsequently harden. Inorganic materials such as plaster, or ceramic materials may be similarly employed.

In order to economize on the usage of potting compound and to decrease the weight of the finished brush, several steps may be taken to limit the amount of potting compound employed. The compound itself may be a foamed material, that is to say a material which includes numerous gas bubbles therein so as to increase its volume and decrease its weight. Such compounds are well known to those of skill in the art and need not be elaborated on herein. Likewise, inert filler materials such as silica, talc and the like may be utilized in the potting compound to decrease the volume employed. As illustrated in FIG. 2, the central sleeve 18 includes an auxiliary sleeve 28 adapted to define an annular opening 30 substantially encircling the central opening 16, and limiting the amount of adhesive employed. In order to retain sufficient strength, it may be desirable to include a plurality of stiffening ribs 32 extending through the annular opening, as illustrated in FIG. 1.

As mentioned previously, a plurality of disk-shaped brushes may be disposed upon a single arbor so as to fabricate a large area feather brush and such brushes are particularly suited for use in tacking applications. FIG. 3 depicts one such arrangement. As shown, a plurality of disk-shaped brushes 10, generally similar to those described with reference to FIG. 1 are mounted upon a central arbor 34 for rotation. As depicted in the cross sectional view, the feathers on the brushes are of varying lengths. A first group of brushes 10*a* includes feathers of a relatively long length while a second group of brushes 10*b* includes shorter feathers. In this manner a large area tack brush 40 is provided having a contour along its length. Such a brush may be utilized to tack irregular contours such as the roof line of an automobile, prior to painting.

When a plurality of disk-shaped brushes are disposed upon a common arbor it is generally desired that the brushes rotate as a unit. Such rotation may be accomplished by any method known to those of skill in the art. For example, the individual brushes may be tightly affixed to the arbor shaft, as for example by a set screw, a clamp a key or similar such means. In other instances, the entire group of brushes may be affixed together as for example by a screw or rod clamp passing therethrough. In yet other instances a noncircular arbor such as an arbor with a square or other polygonal cross section may be employed in conjunction with a hub having a similarly shaped central opening. While all such methods of affixing the brushes are within the scope of the present invention, it has been found particularly advantageous to fabricate the hubs of the brushes to include protruding portions adapted to engage adjoining hubs so as to allow for ready rotation thereof. Use of such a mechanical linkage avoids problems of affixing brushes to an arbor and allows for ready replacement of a single brush without the necessity of removing multiple fixtures.

FIG. 4 depicts one such arrangement of protrusions adapted to engagingly rotate adjacent brushes. Depicted is a stylized, perspective view of a portion of the hubs of two disk-shaped brushes, illustrating one method of mechanical engagement. Shown in the figure are only the centermost portions of the two hubs 18. It will be noted that each sleeve portion includes a hemicylindrical protrusion 42 extending therefrom. This protrusion 42 may be advantageously formed by simply molding or milling a desired shape onto the hub as it is being fabricated. As illustrated, the protrusion 42 of each sleeve 18 engages a similar protrusion on an adjacent sleeve. Obviously, other such protrusions may be similarly employed and are anticipated by the present disclosure. For example, the hubs may be formed with sockets designed to engage protrusions in adjacent hubs.

Although the present invention has primarily been described with reference to the fabrication of disk-shaped brushes fabricated from feathers, the disclosure is obviously not so limited, The principles disclosed herein may be utilized to fabricate brushes in shapes other than disks as for example planar brushes, cylindrical brushes, curved brushes and the like by utilizing a resilient member in conjunction with a base or hub member and an adhesive compound. For example, cylindrical feather brushes are frequently employed in tacking operations, particularly when small areas are to be cleaned. Such cylindrical brushes may be readily fabricated by the techniques of the present invention by disposing a cylindrical resilient member about a hub and inserting several tiers of feathers thereinto, and subsequently adding an adhesive potting compound as mentioned hereinabove. Fabricating a brush in this manner eliminates the need for stacking a plurality of disks and is frequently advantageous in the manufacture of relatively small brushes.

The present invention may be advantageously employed to fabricate brushes and similar items utilizing material other than feathers. For example, it was mentioned that synthetic feather substitutes may be employed; and such substitutes may be fabricated by inserting tufts of pile material into the resilient member for adhesive affixation. Similarly, bristles or other fibers may be inserted and affixed so as to provide bristle type brushes. It should be obvious in light of the foregoing that the preceeding drawings, description and discussion are merely meant to illustrate particular embodiments of the instant invention and are not limitations upon the practice thereof. It is the following claims, including all equivalents which define the scope of the present invention.

I claim:

1. A feather brush comprising:

a resilient member adapted to be penetrated by the shaft of a feather;

a disk-shaped hub having said resilient member affixed to the perimeter thereof;

a plurality of feathers, the shafts of which are inserted into said resilient member in a predetermined pattern corresponding to the radius of the hub, so that a portion of each of said shaft penetrates the resilient member and projects from a second side thereof; and a body of adhesive material disposed on the second side of the resilient member and affixing said shafts so that they cannot be removed therefrom.

2. A brush as in claim 1, wherein said disk-shaped hub further includes a central opening, whereby said brush is adapted to be mounted on an arbor.

3. A brush as in claim 2, wherein said hub includes a projecting member proximate said central opening, said projecting member adapted to engage a proximately disposed disk-shaped brush, whereby said brushes are adapted to rotatingly engage one another upon said arbor.

4. A brush as in claim 1, wherein said resilient member is a foamed polymeric material.

5. A brush as in claim 1, wherein said feathers are ratite feathers.

6. A brush as in claim 1, wherein said feathers are synthetic feathers.

7. A large area feather brush comprising a plurality of disk-shaped brushes mounted in side by side relationship upon an arbor, each disk-shaped brush comprising:

a disk-shaped hub, said hub including a central sleeve adapted to receive said arbor;

a strip of resilient material encircling the outer perimeter of said disk-shaped hub and cooperating with said central sleeve to define a toroidal cavity;

a plurality of feathers inserted in said resilient strip so that at least a portion of the shaft of each of said feathers projects into the toroidal cavity; and, a body of adhesive material substantially filling the toroidal cavity so as to afix the feathers therein.

8. A brush as in claim 7, wherein the feathers of adjacent disk-shaped brushes are all of the same length whereby the brush is of substantially uniform diameter.

9. A brush as in claim 7 wherein the feathers of a first disk-shaped brush and those of a second disk-shaped brush are of two different lengths, whereby the brush has a diameter which varies along the length thereof.

10. A brush as in claim 7 wherein each disk-shaped brush has an engagement member associated therewith to engage the adjacent disk-shaped brush whereby said brushes are adapted to rotate as a unit.

11. A method of fabricating a feather brush, said method comprising:

providing a generally disk-shaped hub;

providing a strip of resilient material capable of being penetrated by the shaft of a feather, substantially encircling said hub so as to define a cylindrical cavity, the height of said cavity corresponding to the width of said strip and the diameter of said cavity corresponding to the diameter of the disk;

inserting a plurality of feathers into said resilient member in a predetermined pattern so that the shafts thereof project into the cylindrical cavity, whereby said resilient member retains the feathers in said predetermined pattern;

adhesively affixing the shafts of said feathers within said cavity.

12. A method as in claim 11, wherein the step of providing a strip of resilient material includes selecting said material from the group consisting essentially of: rubber, foam rubber, synthetic polymers, foamed synthetic polymers and combinations thereof.

13. A method as in claim 11, wherein the step of inserting said feathers includes selecting said feathers from the group consising essentially of natural feathers, synthetic feathers and combinations thereof.

* * * * *